US006753779B1

(12) United States Patent
Kolton et al.

(10) Patent No.: US 6,753,779 B1
(45) Date of Patent: Jun. 22, 2004

(54) ELECTRONIC ARTICLE SURVEILLANCE MARKER ASSEMBLY

(75) Inventors: Chester Kolton, Westfield, NJ (US); Michael Norman, East Brunswick, NJ (US); Robert Whittemore, Middletown, NY (US)

(73) Assignee: B&G Plastics, Inc., Newark, NJ (US)

( * ) Notice: Subject to any disclaimer, the term of this patent is extended or adjusted under 35 U.S.C. 154(b) by 0 days.

(21) Appl. No.: 10/364,493

(22) Filed: Feb. 11, 2003

(51) Int. Cl.[7] ..... G08B 13/14
(52) U.S. Cl. ..... 340/572.1; 340/571; 340/572.8; 340/693.9
(58) Field of Search ..... 340/572.1, 572.8, 340/571, 5.8, 568.1, 693.9, 693.12; 20/602.1; 29/428; 40/299.01, 300, 301, 302, 625, 669; 292/307 R; 235/487, 375; 361/600

(56) References Cited

U.S. PATENT DOCUMENTS

| | | | | |
|---|---|---|---|---|
| 3,995,900 A | * | 12/1976 | Humble et al. | 70/57.1 |
| 4,649,397 A | * | 3/1987 | Heaton et al. | 343/895 |
| 4,718,697 A | * | 1/1988 | Berardus van Amelsfort | 40/299.01 |
| 5,346,066 A | * | 9/1994 | Jones | 206/457 |
| 5,891,156 A | * | 4/1999 | Gessner et al. | 606/117 |
| 5,945,909 A | * | 8/1999 | Kolton | 340/572.1 |
| 6,098,324 A | * | 8/2000 | Nepote | 40/301 |
| 6,204,764 B1 | * | 3/2001 | Maloney | 340/568.1 |
| 6,483,434 B1 | * | 11/2002 | UmiKer | 340/572.1 |

* cited by examiner

*Primary Examiner*—Davetta W. Goins
(74) *Attorney, Agent, or Firm*—Robin, Blecker & Daley

(57) ABSTRACT

An electronic article surveillance assembly comprises a housing defining an interior compartment, an electronic article surveillance marker secured in the interior compartment, and a securement device insertable in the housing and having securement structure extending outwardly of the housing for attaching the housing to an article of manufacture.

4 Claims, 3 Drawing Sheets

ELECTRONIC ARTICLE SURVEILLANCE MARKER ASSEMBLY

FIELD OF THE INVENTION

This invention relates generally to shoplifting prevention and pertains more particularly to electronic article surveillance (EAS) marker assemblies.

BACKGROUND OF THE INVENTION

Commonly-assigned U.S. Pat. No. 5,945,909 discloses a so-called "seal" comprising a one-piece body having first and second members closable one upon the other and thereupon respectively defining first and second outer seal walls and a tail peripherally continuous with at least one of the first and second members at a third outer seal wall, the tail having a hook at a free end thereof. The seal body defines an interior recess and a detent opening into said third outer seal wall for retentive reception of the tail hook interiorly of the seal. An EAS marker is disposed in the seal body recess and is contained therein between the first and second outer seal walls upon closure of the first and second members.

The '909 patent seal is used by circumscribing a portion of an article, e.g., a watchband, with the tail and then inserting the tail hook into seal body detent.

The EAS marker is a flat ferromagnetic strip member and is detectable by various known EAS systems, e.g., where the marker is not deactivated (as at an article payment checkout counter) and is carried through EAS marker detection gates at a facility exit.

SUMMARY OF THE INVENTION

The present invention has as its primary object the provision of improved EAS marker assemblies.

A more particular object of the invention is to provide an EAS marker assembly for with pneumatic/hydraulic tools and the like.

In attaining these and other objects, the invention provides an electronic article surveillance assembly comprising a housing defining an interior compartment, an electronic article surveillance marker secured in the interior compartment, and a securement device separable from and insertable in the housing and having securement structure extending outwardly of the housing for attaching the housing to an article of manufacture.

In a method aspect, the invention provides a method of providing an article of manufacture with electronic article surveillance protection comprising the steps of providing an openable and closable housing, securing an electronic article surveillance marker in the housing while the housing is in an open state, inserting a securement device into the housing while the housing is in an open state, the securement device being selected to have securement structure extending exteriorly of a wall of the housing and compatible with securement structure of the article of manufacture, securing the housing to the article of manufacture by joining the securement device to the securement structure of the article of manufacture and placing the housing in closed state.

The invention will be further understood from consideration of the following description of preferred embodiments thereof and from the drawings where like reference numerals identify like parts throughout.

DETAILED DESCRIPTION OF PREFERRED EMBODIMENTS

Figure 1:
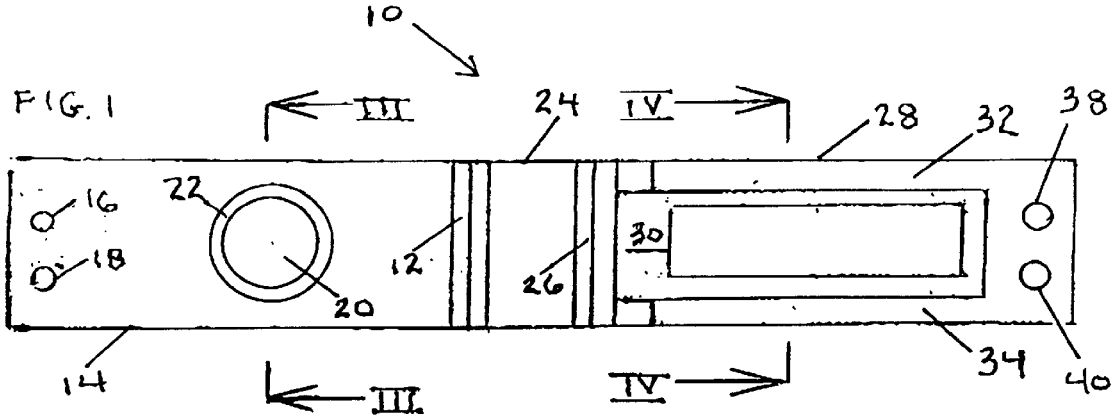
FIG. 1 is a front elevation of an EAS assembly in accordance with the invention.
Figure 2:
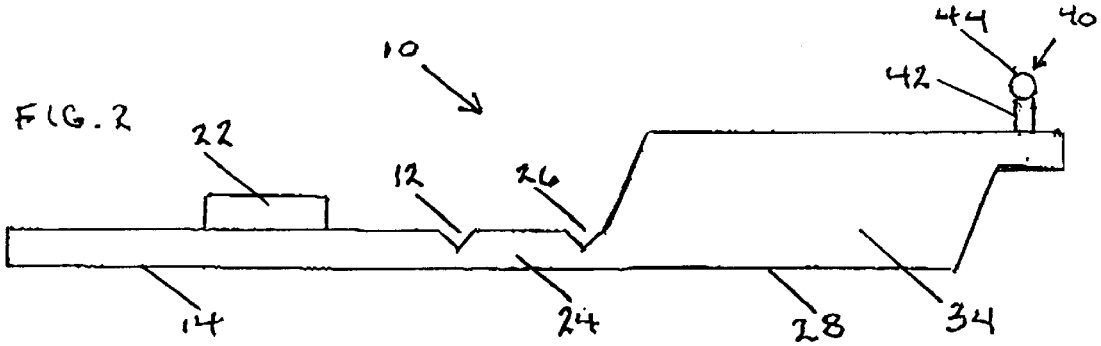
FIG. 2 is a top plan elevation of the EAS assembly of FIG. 1.
Figure 3:
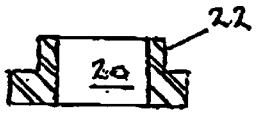
FIG. 3 is a sectional view as would be seen from plane III—III of FIG. 2.
Figure 4:
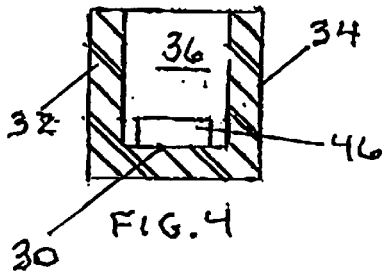
FIG. 4 is a sectional view as would be seen from plane IV—IV of FIG. 2.

Referring to FIGS. 1–4, housing 10 is comprised of plastic material and includes a first hinge portion 12, leftwardly of which is a first housing portion 14. First housing portion 14 defines end latching apertures 16 and 18 and a further aperture 20 bounding by flange 22.

A second housing portion 24 extends rightwardly of first hinge portion 12 to a second hinge portion 26.

A third housing portion 28 extends rightwardly of second hinge portion 26 and defines floor 30 and upstanding sidewalls 32 and 34, defining interior housing compartment 36. Latching posts 38 and 40 extend upwardly of third housing portion 28, each post having a stem 42 and a generally spherical enlargement 44 atop stem 42.

EAS marker 46 is adhesively secured to housing floor 30, residing in interior housing compartment 36.

Figure 5:
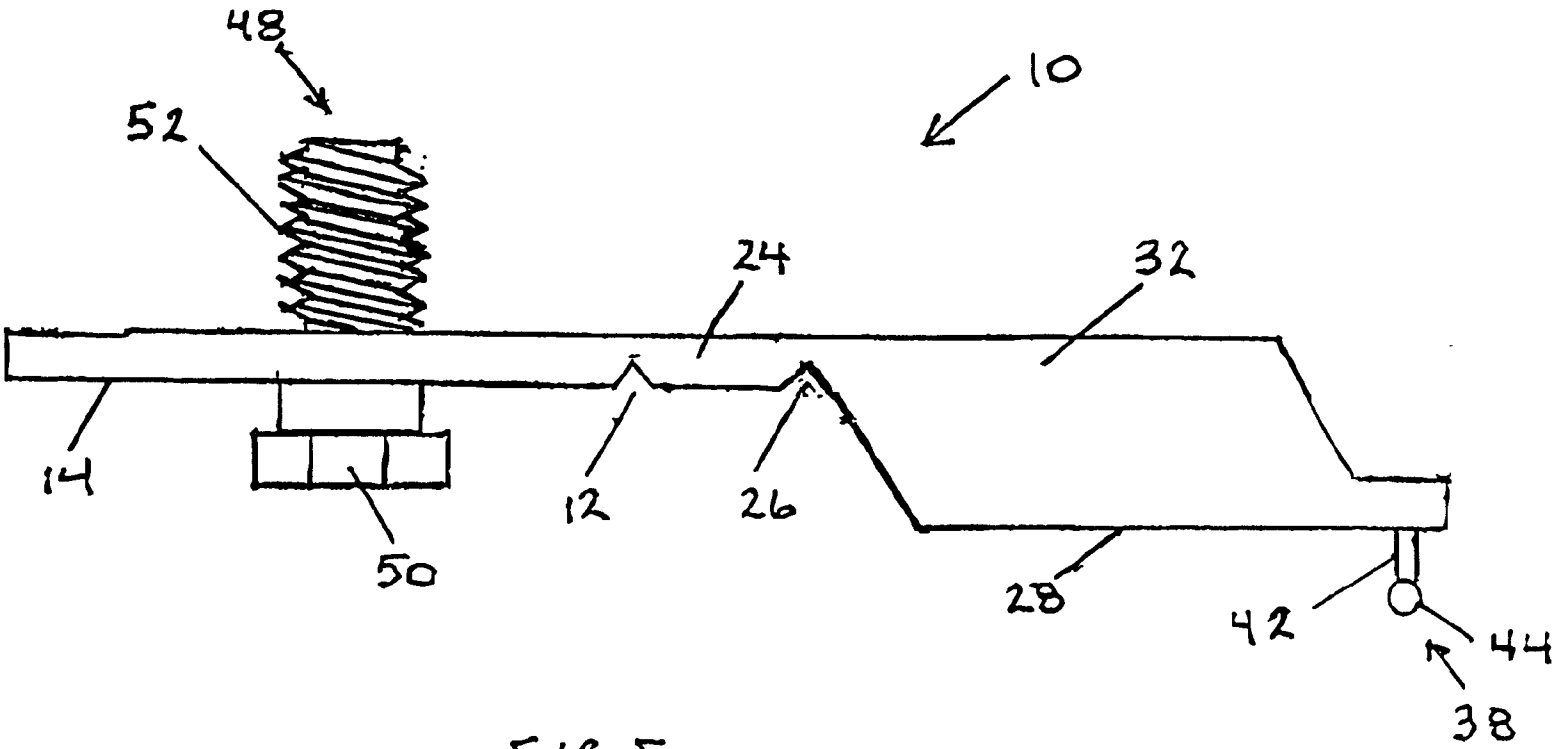
FIG. 5 depicts the FIG. 1 EAS assembly inverted from the FIG. 1 showing and with a securement device assembled therewith.

Referring to FIG. 5, a securement device 48, shown as a bolt having nut portion 50 and exteriorly threaded screw portion 52, is inserted through aperture 20 such that screw portion extends outwardly of housing first portion 14.

Figure 6:
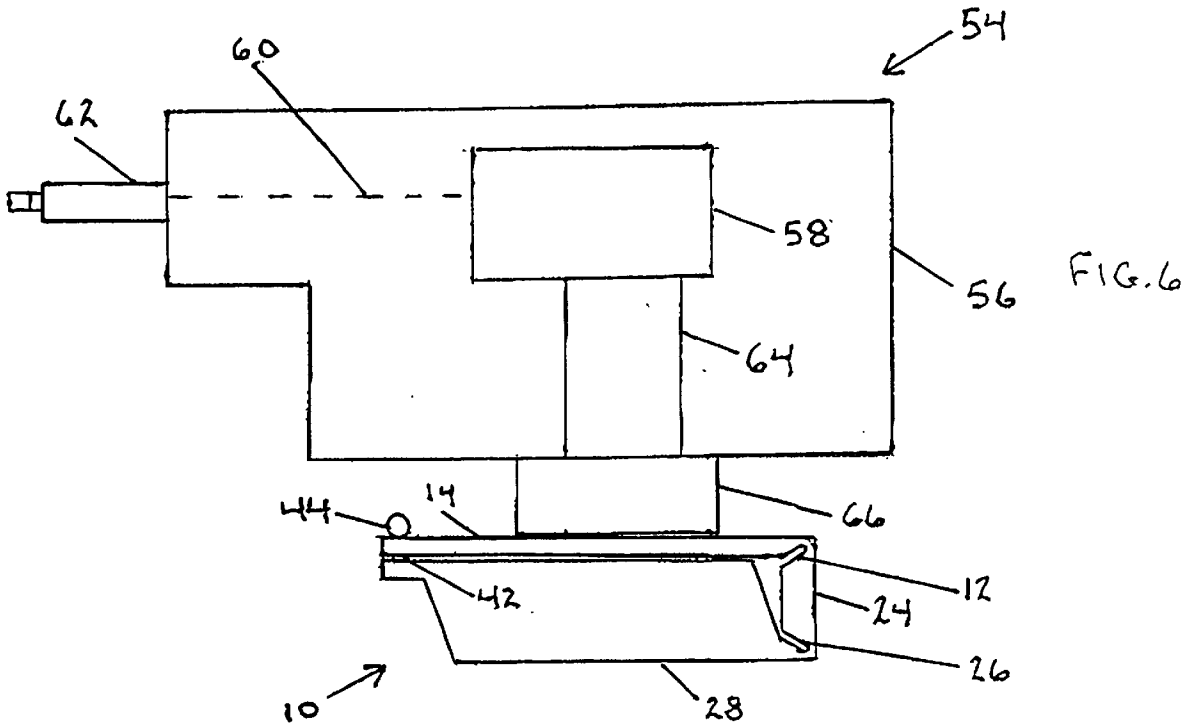
FIG. 6 is a schematic showing of a pneumatic tool with the structure of FIG. 5 connected therewith.

Referring to FIG. 6, a fluid medium-operated tool 54, shown schematically, includes housing 56, fluid medium-operated motor 58, motor output shaft 60 and output bit 62, shown as a screw driving bit. Fluid medium channel 64 extends from motor 58 to an input fitting 66 which defines an inlet port and interior threading (not shown). Such structure of FIG. 6 thus discussed is present in various commercially available pneumatic/hydraulic tools.

Per the subject invention securement device 48 is threaded into fitting 66, thus securing housing first portion 14 to tool 54. Housing second portion 24 is now folded about first hinge portion 12, as shown in FIG. 6, and housing third portion 28 is now folded about second hinge portion 26, stems 42 residing in the housing first portion apertures 16 and 18 and enlargements 44 being in locking engagement with the outer surface of housing first portion 14.

Figure 7:
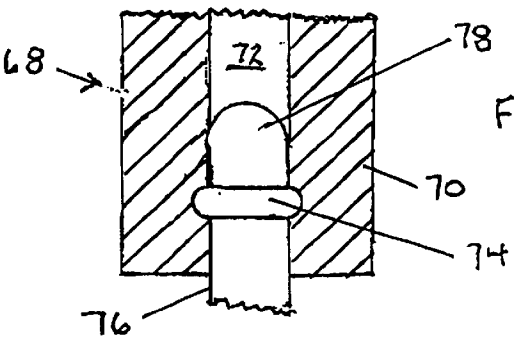
FIG. 7 depicts an alternate form of securement device in accordance with the invention together with a tool fitting therefor.

Some fluid medium-operated (hydraulic/pneumatic) tools have fittings adapted to receive nipple-type inserts. Referring to FIG. 7, tool fitting 68 includes housing 70, defining a fluid channel 72 and seating O-ring 74 therein. EAS assembly securement device 76, in this instance, is configured as shown, seated in housing 70 and having domed entry portion 78 and a reduced diameter portion (interiorly of O-ring 74) for sealing engagement with O-ring 74.

As will be understood from the foregoing, the invention provides an electronic article surveillance assembly comprising a housing defining an interior compartment, an electronic article surveillance marker secured in the interior compartment, and a securement device separable from and insertable in the housing and having securement structure extending outwardly of the housing for attaching the housing to an article of manufacture. The housing includes a first portion defining an aperture through which the securement device extends outwardly of the housing. The housing includes a second portion pivotally secured to the first portion and a third portion pivotally secured to the second portion, the electronic article surveillance marker being secured in the housing third portion. The housing first portion defines a ceiling for the housing, the housing second portion defines an end wall for the housing and the housing third portion defines a floor, opposed sidewalls and a further end wall for the housing, the housing first portion and the housing third portion jointly defining detent structure for securing the housing in closed condition. The housing and the securement device are comprised of plastic. The securement device may define threading exteriorly of the housing or other securement structure as shown in FIG. 7.

Various changes to the particularly depicted embodiments of the invention may be introduced without departing from the scope of the invention. Accordingly, it is to be appreciated that the particularly disclosed embodiments are intended in an illustrative, and not in a limiting, sense. The true spirit and scope of the invention is set forth in the ensuing claims.

What is claimed is:

1. In combination:

a tool having an inlet for receiving a fluid medium for operating said tool; and an electronic article surveillance marker assembly, comprising a first housing having an electronic article surveillance marker secured therein, a second housing and a securement member extending through and exteriorly of said second housing and in secured relation in said tool inlet, said second housing being secured with said first housing following said securement of said securement member in said tool inlet to define said assembly, a tightening portion of said securement member being in spaced facing relation to said electronic article surveillance marker interiorly of said assembly.

2. The invention claimed in claim 1, wherein said tool inlet is interiorly threaded and wherein said securement member is exteriorly threaded and in meshed relation to the inlet interior threading.

3. The invention claimed in claim 1, wherein said first housing and said second housing jointly define detent structure for securing said first and second housings to one another.

4. The invention claimed in claim 1, wherein said first and second housings and said securement member are comprised of plastic.

* * * * *